US005628435A

United States Patent [19]

Rees

[11] Patent Number: 5,628,435

[45] Date of Patent: May 13, 1997

[54] DEVICE FOR INVERTING TUBULAR FABRICS

[76] Inventor: Dennis W. Rees, 934 S. Hoytsville Rd., Coalville, Utah 84017

[21] Appl. No.: 567,407

[22] Filed: Dec. 5, 1995

Related U.S. Application Data

[63] Continuation of Ser. No. 281,913, Jul. 28, 1994, abandoned.

[51] Int. Cl.[6] ..... A41H 43/00

[52] U.S. Cl. ..... 223/39; 223/41

[58] Field of Search ..... 223/39, 40, 41, 223/43

[56] References Cited

U.S. PATENT DOCUMENTS

| | | | |
|---|---|---|---|
| 287,214 | 10/1883 | Arthur . | |
| 372,324 | 11/1887 | Otis . | |
| 382,958 | 5/1888 | Eschner . | |
| 587,354 | 8/1897 | Worrall . | |
| 620,251 | 2/1899 | Pratt . | |
| 1,750,005 | 3/1930 | Hemmerich . | |
| 2,058,065 | 10/1936 | Dersom | 223/41 |
| 2,182,424 | 12/1939 | Chercass . | |
| 2,447,192 | 8/1948 | Ludington . | |
| 3,166,223 | 1/1965 | Gazzaniga | 223/41 |
| 3,467,289 | 9/1969 | Preston . | |

*Primary Examiner*—Bibhu Mohanty
*Attorney, Agent, or Firm*—Workman, Nydegger & Seeley

[57] ABSTRACT

A device for inverting tubular fabrics having a base with a back and a front and a plurality of turning arms, each arm having a centerline, a distal end and a proximal end. The proximal ends of each turning arm are fixedly attached to the base so that the distal ends are substantially axially aligned along the centerline of the distal ends and the distal ends of each turning arm are opposing in direction. One embodiment of the device for inverting tubular fabrics further contemplates turning ends having a first and a second end with the first end of the turning end attached to the distal end of the turning arm and the second end of the turning end having a cylinder face of either convex or concave shape. Means for securing the device to another object are further provided, including but not limited to, magnetic elements secured to the back of the device and/or holes formed through the base of the device capable of receiving bolts for securing the device to other objects.

15 Claims, 2 Drawing Sheets

DEVICE FOR INVERTING TUBULAR FABRICS

This application is a continuation of U.S. application Ser. No. 08/281,913, filed Jul. 28, 1994, for Devices for Inverting Tubular Fabrics now abandoned.

BACKGROUND

1. Field of the Invention

The present invention relates generally to an apparatus for inverting tubular fabrics. More specifically, the present invention relates to an apparatus for inverting fabrics that have at least a portion thereof in a tubular shape.

2. Background Art

Many articles of clothing are manufactured with a portion thereof being generally tubular. These include arms and legs of shirts, pants and other garments, pantyhose, stockings and other articles where a portion thereof is substantially tubular. It is often necessary to turn these articles inside out because they become inverted either from initial manufacture or subsequent to manufacture through use and washing.

Articles of clothing manufactured out of tubular fabrics are often sewn along one side or one end. The finished product will therefore have a seam with raw edges exposed. After manufacture the article must then be inverted so the seam is hidden within the tubular portion of the garment. Subsequent to manufacture, tubular elements of garments are often turned inside out when they are removed or during washing. These conditions necessitate turning the garment inside out or inverting the tubular elements to its correct position. When a large number of articles must be turned inside out or inverted, it becomes very tedious to perform this operation by hand. Additionally, inverting tubular elements by hand is time consuming.

Over the years, devices have been developed to help invert tubular fabrics. Many of the devices are targeted specifically to a manufacturing environment with little thought to the home consumer. These devices are often very complicated with moving parts; increasing the complexity of operation and the chance of injury to the user.

Additionally, many devices also require the operator to remove his or her hands from the article being turned to operate the machine. Furthermore the complexity of these devices increases costs of manufacture and reduces reliability. The complexity and cost of these devices makes them generally unsuitable for the average consumer.

Furthermore, a company desiring to use the historical inverting devices must bear the greater complexity, chance of injury and lengthy time in using such devices. Thus, the costs of any process where such device can be used would be increased, as would the cost resulting from lost days at work from injured workers.

BRIEF SUMMARY AND OBJECTS OF THE INVENTION

It is, therefore, an object of the present invention to provide a device to invert tubular fabrics with reduced complexity relating to moving parts.

Another object of the present invention is to provide a low cost device to invert tubular fabrics suitable for use by the home consumer.

A further object of the present invention is to provide a durable and reliable device to invert tubular fabrics suitable for use by commercial manufacturers.

A still further object of the present invention is to provide a device to invert tubular fabrics that can be used without removing the operators hands from such fabric.

Another object of the present invention is to provide a device to invert tubular fabrics that will reduce the cost of manufacturing.

Still, another object of the present invention is to provide a device to invert tubular fabrics that will reduce the likelihood and severity of injury inflicted on the user.

Again, another object of the present invention is to provide a device to invert tubular fabrics to reduce the time consumed by those wishing to place tubular fabrics in a position ready for use.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims.

To achieve the foregoing objects, and in accordance with the invention as embodied and broadly described herein, a device to invert tubular fabrics is provided. The device comprises a base and a plurality of turning arms.

The turning arms are shaped so as to have a centerline over which the tubular portion of a fabric to be inverted is placed. Additionally the turning arms are shaped so that the centerline is held an appropriate distance off the base. The turning arms are mounted to the base so that the centerlines are substantially aligned and the distal ends thereof are opposing.

One embodiment of the present invention contemplates that each turning arm will also include a turning end. The turning ends may be any solid geometric shape including spheres, ellipsoids, conical sections, or cylinders. The turning ends are enlarged relative to the diameter of the turning arm. By way of example and not limitation, one potential shape for the turning end is cylindrical. The cylindrical turning end may be formed integrally with the turning arm. In this configuration, all sharp edges which could potentially snag a fabric are eliminated.

In another embodiment, the end face of a cylindrical turning end may have a convex or concave shape.

In a further embodiment of the present invention one or more of the turning ends have disposed thereon a means for increasing the friction between the fabric and the turning end. The means for increasing friction between the turning end and the fabric includes any method sufficient to provide increased friction without damaging the material of the tubular fabric. By way of example and not limitation, this may include turning ends with a textured surface, a textile material with a course nap, or other material with a rough or tacky surface.

Still another embodiment of the present invention contemplates turning arms of various cross sections. By way of example and not limitation, a turning arm may be conical in shape where the cone gradually narrows toward the end of the turning arm. In this embodiment, the turning arms are formed without turning ends.

Still another embodiment of the present invention contemplates a combination of a turning arm with a varying cross section and a turning end. In this way various cross sections of turning arms may be combined with various shapes of turning ends to produce devices with various properties. By way of example and not limitation, the conical shape turning arm may be combined with the cylindrical shaped turning end to produce a combination that is somewhat funnel shaped.

A further embodiment of the present invention contemplates including means for mounting the base of the device to another object. The means for mounting the base to another object can be tailored to the shape of the object on which the device is to be mounted. By way of example and not limitation, the means for mounting the device to another object may include a series of magnetic elements. As another example, without limitation, the base may have formed therein one or more holes adapted to accept a bolt. As used within the scope of this patent, the term bolt is meant to include any number of fasteners that operate in a similar manner. These fasteners include a myriad of bolts, screws, anchors, and hollow wall fasteners and one of ordinary skill in the relevant art will appreciate that this list is not, and clearly cannot, be exhaustive.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings, and which constitute the best mode presently contemplated with respect to the invention.

Understanding that these drawings depict only typical embodiments of the invention and are therefore not to be considered limiting of its scope, the invention will be described with additional specificity and detail through the use of the accompanying drawings in which.

DETAILED DESCRIPTION OF THE PREFERRED EMBODIMENTS

Figure 1:
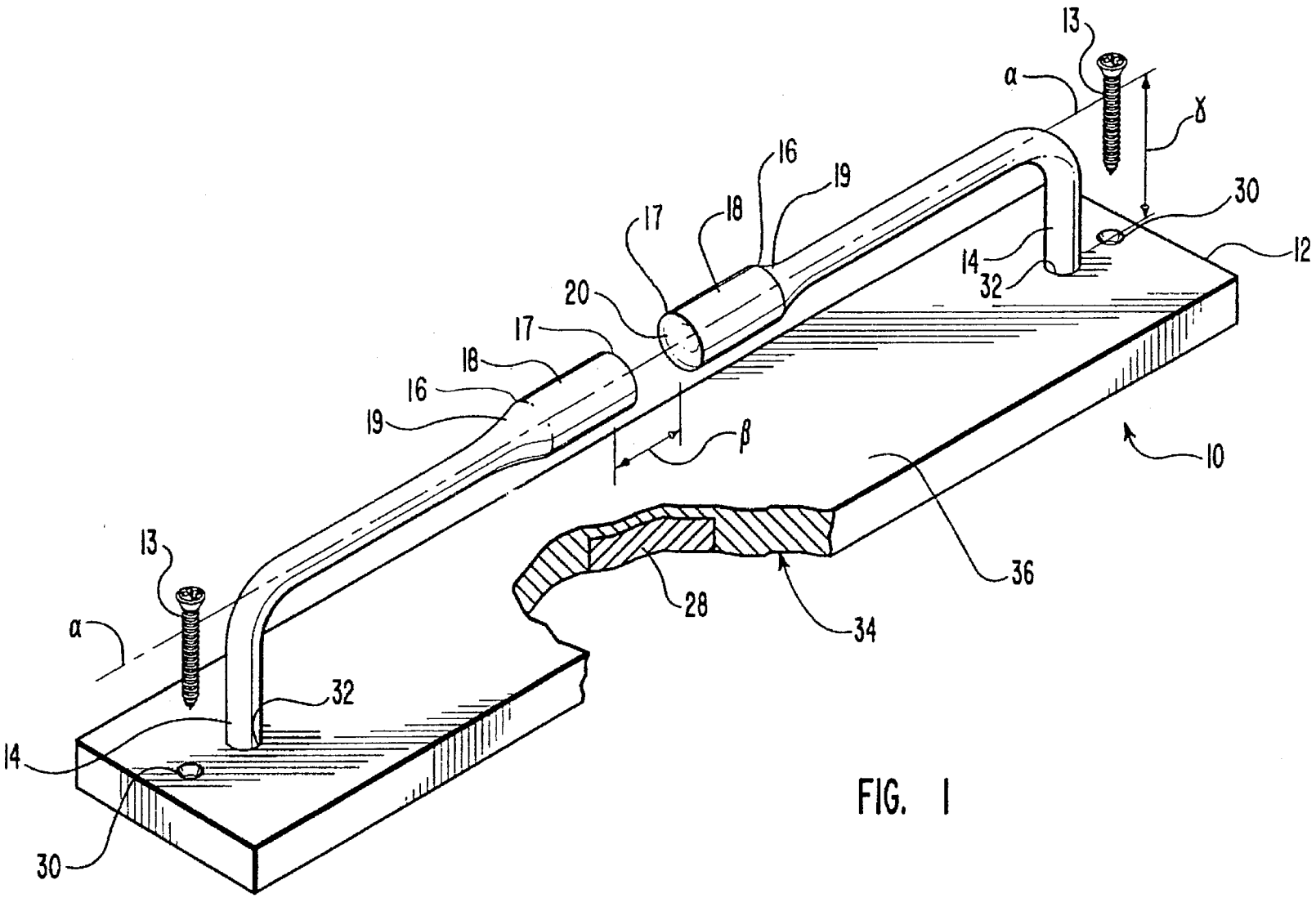
FIG. 1 is a perspective view of a preferred embodiment incorporating the teachings of the present invention.

FIG. 1 is a perspective view of a preferred embodiment incorporating the teachings of the present invention. Generally designated as reference numeral 10. Device 10 comprises base 12 having a back 34 and a front 36, plurality of turning arms 14, and turning end 18 attached at distal end 19 of turning arm 14. Turning arms 14 are fixedly attached to base 12 at proximal end 32, such that turning ends 18 are positioned apart by a separation distance $\beta$. In the preferred embodiment separation distance $\beta$ is within the range from ¼ inch to 1 inch with the preferred distance ⅝ inch. Separation distance $\beta$ permits the optimal separation between turning ends 18 since the user can easily insert a tubular fabric between turning ends 18 and invert the tubular fabric without having the same slip off device 10.

Turning arms 14 are positioned such that distal ends 19 of each turning arm 14 are substantially axially aligned along centerline $\alpha$. Turning end 18 may be integrally formed with turning arm 14 or may be constructed so as to be selectively removable to permit multiple styles and shapes of turning ends that will be discussed in more depth hereafter. While turning end 18 may take a variety of shapes, in the preferred embodiment turning end 18 is cylindrical as shown generally in FIG. 1. In the preferred embodiment cylindrical turning ends 18 are formed integrally with distal end 19 of turning arms 14 so as to permit smooth and sculpted edges at the junctions of turning end 18 at first end 16 and distal end 19 of turning arm 14 to prevent snagging tubular fabrics inverted by use of device 10. Additionally in one embodiment of the invention cylinder face 20 at second end 17 of turning end 18 is concave in shape. The concavity of cylinder face 20 at second end 17 of turning end 18 further reduces any snagging of tubular fabrics being inverted on device 10 and increases the mobility of tubular fabrics being placed on device 10 for inverting.

The distance between centerline $\alpha$ and base 12 is depicted in FIG. 1 as vertical distance $\gamma$. Vertical distance $\gamma$ should be sufficiently great enough to allow passage of the portion of the tubular fabric being inverted over turning arm 14 without severely clumping the tubular fabric or restricting movement.

Means for mounting base 12 may further comprise the invention disclosed herein. By way of example and not limitation, means for mounting base 12 to another object comprise at least one hole 30 formed through base 12 capable of receiving at least one bolt 13. Another example, without limitation, of means for mounting base 12 to another object comprises at least one magnetic element 28 mounted on back 34 of base 12. In one preferred embodiment, back 34 of base 12 is fitted with multiple magnetic elements 28 to increase the magnetic force between multiple magnetic elements 28 and the object upon which device 10 is desired to be secured. In still another embodiment, by way of example and not limitation, means for mounting base 12 to another object may comprise a combination of holes 30 and magnetic elements 28 to further secure device 10 to another object.

One of ordinary skill in the relevant art will appreciate that means for mounting can include a myriad of bolts, screws, anchors and hollow wall fasteners to secure device 10 to another object. Means for mounting base 12 to another object could further include the use of VELCRO in multiple forms. By way of example and not limitation, VELCRO straps could be attached to the base and used to wrap around the other object and interconnecting with itself. Also, multiple VELCRO strips attached to the base that can interconnect with VELCRO strips secured to the other object may be employed as means for mounting. The primary requirement of means for mounting disclosed, is to reduce any unnecessary movement between device 10 and another object during the inversion of tubular fabrics. One of skill in the relevant art would appreciate that a greater mass of the tubular fabric normally inverted on device 10 would require device 10 to be more tightly secured against another object. Therefore, for more massive tubular fabrics the combination between magnetic element 28 and hole 30 with bolt 13 would further comprise the invention disclosed herein.

Figure 2:
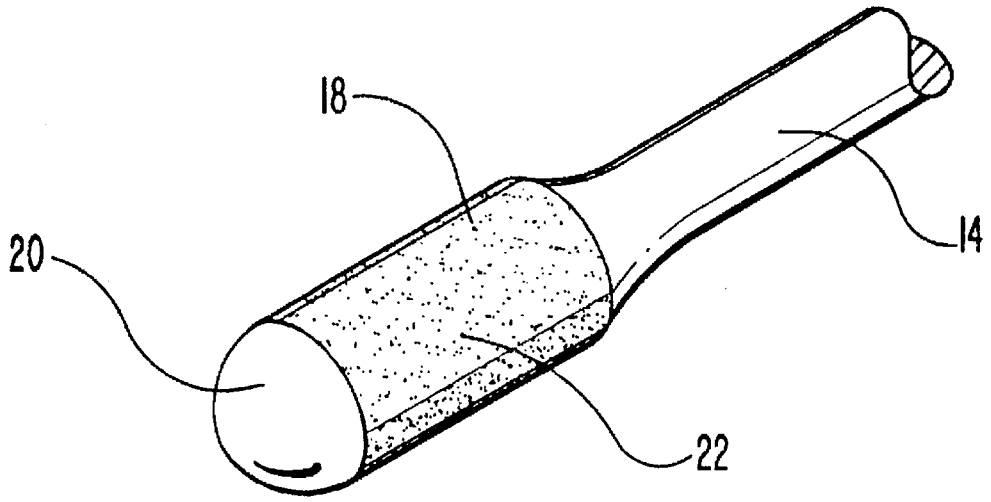
FIG. 2 is a perspective view of the turning end of an alternative embodiment of a device incorporating the teachings of the present invention and using a textured surface to increase the friction between the device and the tubular fabric.

In one embodiment illustrated in FIG. 2, turning end 18 has disposed about the exterior thereof a means for increasing friction between the tubular fabric and turning end 18. Means for increasing friction can be any material or structure sufficient to provide increased friction between turning end 18 and the tubular fabric without severely damaging the tubular fabric or severely restricting inversion. By way of example, and not limitation, FIG. 2 illustrates napping 22 formed substantially on the exterior of turning end 18. One of ordinary skill would appreciate that any material or surface structure which achieves a similar function as napping 22 may likewise be used such that the friction of turning end 18 and the tubular fabric is increased without severely restricting inversion. Furthermore, the shape of turning end 18 disclosed in FIG. 2 is not limited and means for increasing friction could be comprised of any shape of turning end 18 that could actually increase friction and such is contemplated as part of the inventive device.

Figure 3:
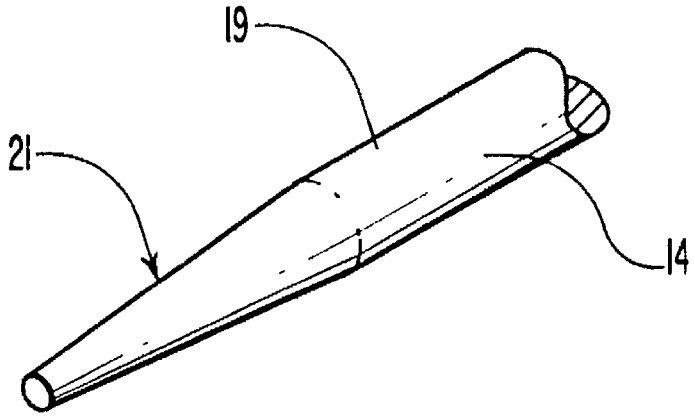
FIG. 3 is a perspective view of another alternative embodiment of a device incorporating the teachings of the present invention where the turning arm is substantially conical.

FIG. 3 illustrates an additional embodiment of the present invention where distal end 19 of turning arm 14 is formed so as to be substantially conical and is generally designated as references numeral 21. In instances where the tubular fabric has a portion thereof of restricted size, conical portion 21 of turning arm 14 could permit easier access to the remainder of turning arm 14 and increase the speed with which tubular fabrics can be inverted. One of ordinary skill in the art would appreciate that turning end 18 could further be shaped similar to conical portion 21 and that turning arm 14 could be secured to turning end 18 of a conical shape.

Further, the present invention is not restricted to having the same shape of turning end 18 for each turning arm 14. Therefore, to increase the utility of the present invention, one turning arm could be fitted with a turning end of cylindrical shape and another turning arm could be fitted with a turning end of conical shape. Also, one turning end could further comprise means for increasing friction while the other turning end could not. It should further be appreciated that the inventive device would be operable still without one or more turning ends, even though operating would not be as efficient.

Operation of the invention device can more easily be explained by reference to a tubular fabric that is substantially tubular throughout. For ease of explanation, therefore, reference shall be made to a sock. The term tubular fabric and the use of the term sock, as used herein, includes any fabric where a portion thereof is substantially tubular in shape. Therefore, for example, the term tubular fabric or sock could include, pants, shirts, stockings, nylons, gloves, hats, or any other device having a portion thereof in a substantially tubular shape. Further, the term fabric may include any material from which a device having a portion thereof substantially tubular is formed. Thus, the term fabric should not be limited solely to cotton, polyester, silk, or other fabric common in clothing, but should also be read to include materials such as plastic, rubber, soft metallic, or other materials more common in commercial plants.

As an example of operation of inventive device 10, the operator positions the sock over one turning end of one turning arm and pulls it along the centerline until the end of the turning end of the turning arm touches the toe of the sock. The operator then directs the outer portions of the sock toward the uncovered turning arm. As the sock moves off the first turning arm and onto the second turning arm, the sock will be inverted. Once the sock has entirely moved onto the second turning arm and inversion is complete, the operator then grabs the toe of the sock and removes it from the device.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by U.S. Patent is:

1. A device for inverting tubular fabrics comprising:

(a) a base having a back and a front; and (b) a first and a second turning arm, each said turning arm having a centerline, a distal end, and a proximal end, said proximal ends of said turning arms being non-movable and fixedly attached to said base so that said distal ends are non-movable, substantially axially aligned along said centerline, and opposingly separated by a distance greater than ¼ inch, said first and second turning arms also being configured so that the tubular fabric can be received over said first turning arm and then inverted so as to be received over said second turning arm; and (c) a turning end attached at said distal end of each of said turning arms, each of said turning end having a concave face being opposingly separated by a distance greater than ¼ inch.

2. A device for inverting tubular fabrics as recited in claim 1, wherein said distal end of said first turning arm is substantially conical.

3. A device for inverting tubular fabrics as recited in claim 1, the device further comprising a means for mounting said base, thereby permitting the device to be secured during use.

4. A device for inverting tubular fabrics as recited in claim 3, wherein said means for mounting said base comprises at least one hole formed through said base, capable of receiving a bolt.

5. A device for inverting tubular fabrics as recited in claim 3, wherein said means for mounting said base comprises magnetic elements positioned on said back of said base.

6. A devise for inverting tubular fabrics as recited in claim 3, wherein said means for mounting said base comprises at least one magnetic element positioned on said back of said base and at least one hole formed through said base capable of receiving a bolt.

7. A device for inverting tubular fabric as recited in claim 1, wherein said distal end of said first turning arm is of a cylindrical shape.

8. A device for inverting tubular fabrics, the device having a centerline and comprising:

(a) a base;

(b) a pair of turning arms, said pair of turning arms each having a proximal end and a distal end, said turning arms being mounted to said base such that said pair of turning arms are non-movable and each of said distal ends of said pair of turning arms are substantially axially aligned along the centerline and said distal ends opposing;

(c) a turning end attached at said distal end of each of said turning arms, each of said turning end having a concave face being opposingly separated by a distance at least ⅝ inch, each said turning end also being configured so that the tubular fabric can be received over one of said turning end and then inverted so as to be received over the other of said turning end; and (d) means for mounting said base thereby permitting the device to be secured during use.

9. A device for inverting tubular fabrics as recited in claim 8, wherein said turning end is formed integrally with said distal end of said turning arm.

10. A device for inverting tubular fabrics as recited in claim 8, wherein said turning arms further comprises a distal end having a conical shape.

11. A device for inverting tubular fabrics as recited in claim 8, wherein said device further comprises means for increasing friction on at least one turning arm.

12. A device for inverting tubular fabric as recited in claim 8, wherein said device further comprises means for increasing friction on at least one turning end.

13. A device of inverting tubular fabrics comprising:

(a) a base having a back and a front;

(b) a pair of turning arms, said pair of turning arms each having a centerline, a distal end, and a proximal end, said proximal ends being fixedly and non-movably secured to said base such that said distal ends of said pair of turning arms are substantially axially aligned along said centerline;

(c) a turning end having a first end and a second end, said turning end attached to said distal end of each of said turning arms at said first end, said second end of said turning end having a concave cylinder face and beveled edges to prevent snagging of the tubular fabrics during inversion and said cylinder faces separated by a distance ranging from ¼ inch to 1 inch, each said turning end also being configured so that the tubular fabric can be received over one of said turning end and then inverted so as to be received over the other of said turning end; and (d) means for mounting said base, thereby permitting the device to be secured during use.

14. A device for inverting tubular fabrics as recited in claim 13, further comprising means for increasing friction formed on one of said pair of turning arms.

15. A device for inverting tubular fabric as recited in claim 14, wherein said means for increasing friction comprises napping formed on said turning end attached to said turning arm.

* * * * *